US005097629A

United States Patent [19]

Guhl et al.

[11] Patent Number: 5,097,629

[45] Date of Patent: Mar. 24, 1992

[54] COUNTERBALANCED WINDOW OPERATORS

[75] Inventors: James C. Guhl, Hudson, Wis.; Hartmut Ginnow-Merkert, Orono, Minn.

[73] Assignee: Andersen Corporation, Bayport, Minn.

[21] Appl. No.: 619,111

[22] Filed: Nov. 28, 1990

[51] Int. Cl.[5] ..... E05F 1/10; E05F 11/00

[52] U.S. Cl. ..... 49/386; 49/324; 74/89.14

[58] Field of Search ..... 49/386, 324, 341, 342, 49/343, 350, 351; 74/89.14, 89.15

[56] References Cited

U.S. PATENT DOCUMENTS

| | | | |
|---|---|---|---|
| 2,226,376 | 12/1940 | Harrison | 49/342 X |
| 2,698,173 | 12/1954 | Rydell | 49/386 X |
| 2,767,979 | 10/1956 | Hummert | 49/324 |
| 3,508,362 | 4/1970 | Wright | 74/89.14 X |
| 4,143,556 | 3/1979 | Hauber | 49/342 X |
| 4,241,541 | 12/1980 | Van Klompenburg et al. | 49/342 X |
| 4,266,371 | 5/1981 | Erdman et al. | 49/342 X |
| 4,305,228 | 12/1981 | Nelson | 49/342 X |
| 4,416,094 | 11/1983 | Bugener et al. | 49/386 X |
| 4,505,601 | 3/1985 | Sandberg et al. | 384/428 |
| 4,521,993 | 6/1985 | Tacheny et al. | 49/325 |
| 4,571,775 | 1/1986 | Leonard | 16/298 |
| 4,617,758 | 10/1986 | Vetter | 49/342 X |

*Primary Examiner*—Philip C. Kannan
*Attorney, Agent, or Firm*—Merchant, Gould, Smith, Edell, Welter & Schmidt

[57] ABSTRACT

A counterbalanced operator for a pivoting unit includes a housing 17 and a rotatable drive member mounted in the housing. A first end 29a of arm member 29 is operatively connected to the drive member. A second end of the arm member is operatively connected to the pivoting end of the unit and a torque from the unit is transmitted to the arm member. A crank 33 rotates the drive member. A spring 40 provides for a means for counterbalancing the torque on the arm member. The spring 40 creates a force, the spring operatively connected to the arm member and the spring positioned in the housing. The force is transmitted from the spring to the arm member.

30 Claims, 5 Drawing Sheets 12e
29c
29
29b
29a
30a
30b
30c
30
21
40a
40b
40
41
42
43
44
46
47
45
45a
45b
48
49
50
54
31
32
27
33
28
β

COUNTERBALANCED WINDOW OPERATORS

BACKGROUND OF THE INVENTION

1. Field of the Invention

This invention relates generally to counterbalanced window operators and more particularly to a counterbalanced operator wherein the counterbalancing force is connected to the arm members and adjustments are able to be made to the counterbalanced mechanism to accommodate various pitches of the roof, weight of the sash and size of the sash.

2. Description of the Prior Art

It is well known in the art to utilize a crank operator for casement type windows. For such windows, the operators have performed satisfactorily. However, when a crank operator has been used for roof or awning windows, various problems have arisen. The first is that due to the weight of the sash, it is necessary that there be a large gear reduction between the crank and the operator mechanism. Typically, it has taken between 25 to 30 revolutions of the hand crank in order to effect a 12 inch movement of the window. Therefore, in order to open a window, it was necessary for a person to make a large number of revolutions of the hand crank. This becomes quite cumbersome for the person operating the mechanism. Furthermore, even with the large gear reduction, the weight of a large roof window sash can cause the cranking torque to be quite high.

Other objects which need to be opened, such as garage doors, are typically counterbalanced in order to allow the person operating the garage door to more easily open and close the garage door. The counterbalancing means are typically located proximate the sides of the garage door. Still further, counterbalancing mechanisms have been utilized in certain windows, but not in the housing of the crank mechanism and not with the counterbalancing forces applied to the same members that open and close the sash from the crank mechanism.

One of the problems which would be encountered in counterbalancing either a roof or awning window would be that the amount of counterbalancing force needed would vary depending upon the pitch of the roof on which the window was placed as well as the size and weight of the sash.

The present application addresses the problems associated with the prior art devices and provides for a counterbalanced window operator with counterbalance forces on the same members as the crank mechanism. The counterbalancing mechanism may be adjusted to take into account the various roof pitches as well as weight and size of sashes. Still further, the mechanism is designed to match the counterbalancing torque to the torque created by the sash throughout the opening and closing of the window.

SUMMARY OF THE INVENTION

The present invention is a counterbalanced operator for a pivoting unit, the unit having a first, pivoted end and a second, rotatable end. The operator includes a housing and a rotatable drive member operatively mounted in the housing. The drive member has an axis of rotation. An arm member, having first and second ends, has its first end operatively connected to the drive member. The second end of the arm is operatively connected to the second end of the pivoting unit, wherein a torque from the unit is transmitted to the arm member.

A rotating drive means is provided for rotating the drive member and further a means for counterbalancing the torque of the arm member is provided. The counterbalancing means creates a force, the counterbalancing means being operatively connected to the arm member such that the force is being transmitted to the arm member.

In another embodiment, the invention is a counterbalanced operator for a pivoting window, the window having a first pivoting end and a second rotatable end. The operator includes a housing and a rotatable drive member operatively mounted in the housing. The drive member has an axis of rotation. An arm member having first and second ends has its first end operatively connected to the drive member. The second end of the arm is operatively connected to the second end of the pivoting window, wherein a torque from the window is transmitted to the arm member. A rotating drive means is provided for rotating the drive member and further a means for counterbalancing the torque of the arm member is provided. The counterbalancing means creates a force, the counterbalancing means being operatively connected to the arm member such that the force is being transmitted to the arm member.

In another embodiment, the invention is a window having a frame with a top end and a bottom end. A sash having a top and bottom end is configured to engage the frame and the top of the sash is pivotally mounted to the top end of the frame. The bottom end being the rotatable end. A counterbalanced operator is provided which includes a housing and a rotatable drive member operatively mounted in the housing. The drive member has an axis of rotation. An arm member having first and second ends has its first end operatively connected to the drive member. The second end of the arm is operatively connected to the second end of the sash, wherein a torque from the sash is transmitted to the arm member. A rotating drive means is provided for rotating the drive member and further a means for counterbalancing the torque of the arm member is provided. The counterbalancing means creates a force, the counterbalancing means being operatively connected to the arm member such that the force is being transmitted to the arm member.

DETAILED DESCRIPTION

Figure 1:
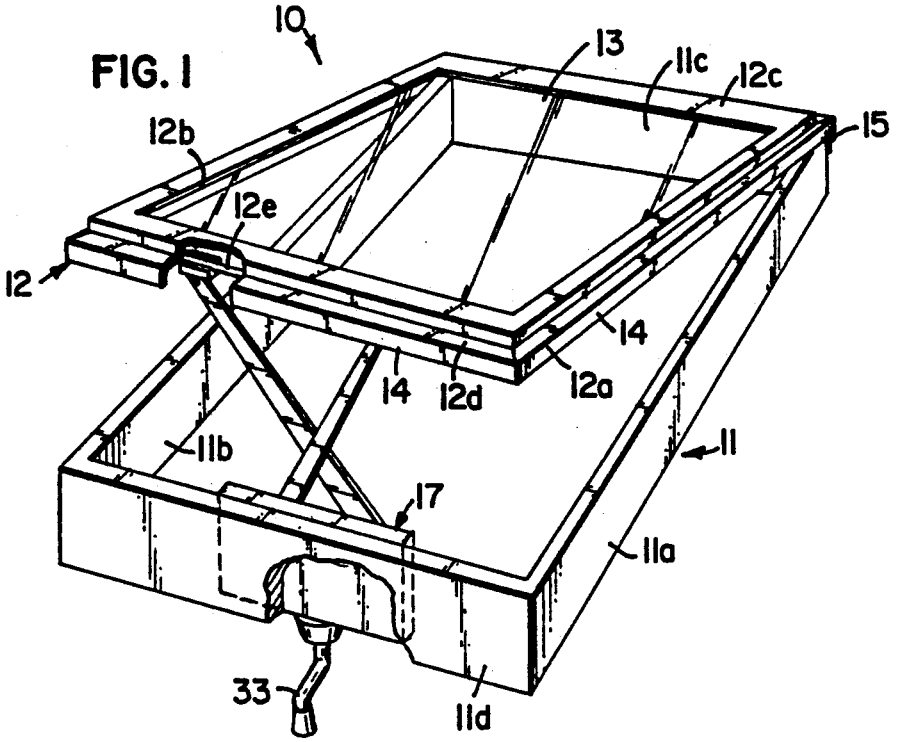
FIG. 1 is a perspective view of a roof window showing the counterbalanced window operator mounted to the sill of the window frame.

Referring to the drawings, wherein like numerals represent like parts throughout the several views, there is generally disclosed at 10 a roof window. The frame, generally designated at 11, includes side members 11*a* and 11*b* connected at the top end by top member 11*c* and at the bottom end by sill 11*d*. A sash, generally designated at 12, has side members 12*a* and 12*b* cooperatively connected by top member 12*c* and bottom member 12*d*. A transparent material 13, usually either glass or plastic, is operatively mounted in the sash 12, by means well known in the art. The transparent material 13 may be single, double or triple pane, depending upon the desired functional characteristics. The sash 12 has an outer flange 14 which extends around the four sides of the sash 12 and is configured to fit over the frame 11 and provide a suitable seal. A hinge 15 is connected to the frame 11 and sash 12 proximate the top end on a first side and another hinge (not shown) is similarly attached to the frame and sash proximate the other side. The construction of the window 10, described so far, is well known in the art and such a construction or other suitable constructions may be utilized with the counterbalanced window operator mechanism 16.

The mechanism 16 includes a housing 17. The housing 17 is generally rectangular in shape and has an inner cavity 17*a*. The housing 17 has a base 18 operatively connected to sidewalls 19, 20 and 21. A top 22 having a downwardly depending sidewall 23 is releasably connected to the housing 17 by means of four screws 24.

Figure 2:
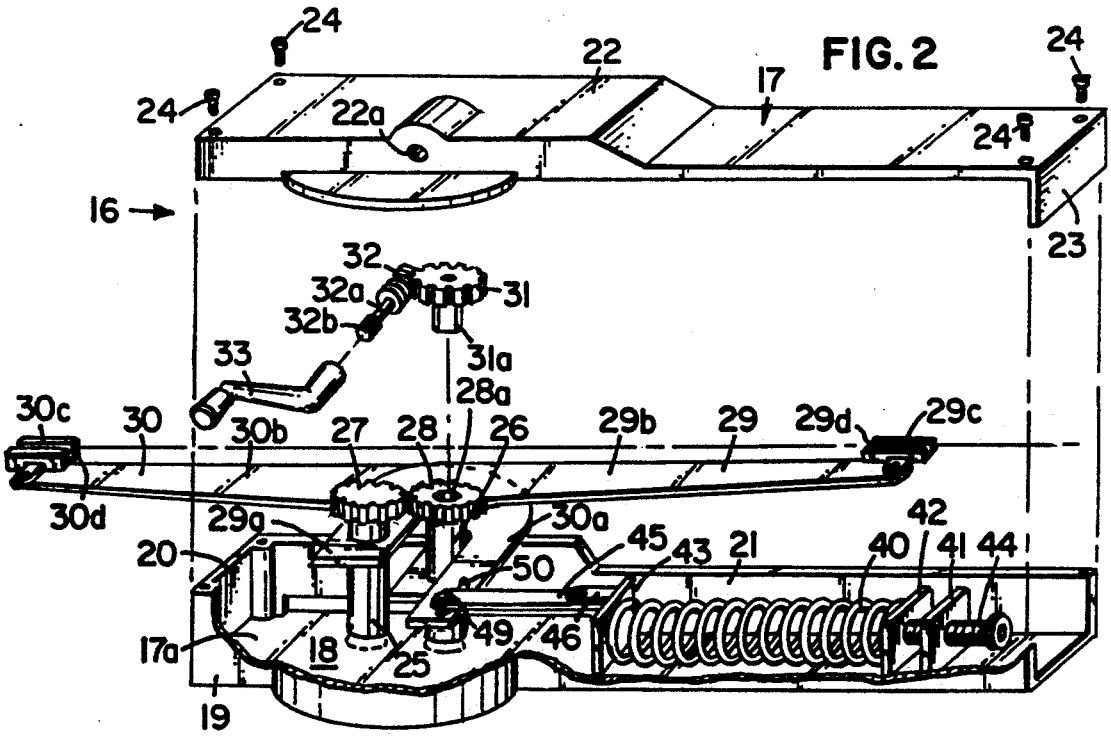
FIG. 2 is a perspective view of the counterbalanced window operator shown in FIG. 1.

Two standoffs 25 and 26 are operatively connected by suitable means to the base 18 to allow the standoffs 25 and 26 to rotate. Two eighteen tooth spur gears 27 and 28 are operatively mounted to the standoffs 25 and 26 respectively. The spur gears 27 and 28 are free to rotate around a generally vertical axes of rotation, as shown in FIG. 2. These axes of rotation are in alignment with the standoffs 25 and 26. The gears 27 and 28 are respectively fixed to the standoffs so that the gears 27 and 28 and standoffs 25 and 26 will rotate together. A first arm 29 is operatively connected to the first standoff 25 and a second arm 30 is operatively connected to the second standoff 26. The arms 29 and 30 may be welded to the respective standoffs such that rotation of the standoffs causes rotation of the arms. The arms 29 and 30 each have a relatively short first leg 29*a* and 30*a* operatively connected to a second leg 29*b* and 30*b*. The first legs are approximately 90° to the second legs. A worm gear 31 has a shaft 31*a* which is positioned in an opening 28*a* of spur gear 28 such that rotational movement of the worm gear 31 causes rotation of the spur gear 28. A worm 32 is positioned so as to be in operative engagement with the worm gear 31. The worm 32 has a shaft 32*a* on which a knurled knob 32*b* is connected. The shaft 32*a* extends through the opening 22*a* in the top 22. The gear 31 is a 63:1 reduction in connection with worm 32. The worm drive gives the operator a self locking feature by preventing unintended sash movement due to gusts of wind or other forces. A crank handle 33 is operatively connected to the knob 32*b* so that revolvement of the crank 33 causes the worm 32 to rotate, thereby causing the worm gear 31 to rotate which in turn causes the spur gear 28 and therefore spur gear 27, which meshes with gear 28, to rotate. The standoffs 25 and 26 thereby rotate carrying with them the arms 29 and 30. The sash 12 has a steel guide bar 12*e* across its bottom end. At the end of each of the arms 29 and 30 are guide shoes 29*c* and 30*c*, respectively. The guide shoes 29*c* and 30*c* have a longitudinal opening 29*d* and 30*d* on which the steel guide bar 12*e* is positioned. The shoes 29*c* and 30*c* are pivotally connected to the arms 29 and 30. It is also understood that the second ends 29*b* and 30*b* may not be directly connected to the sash. Another arm member or linkage member may be connected between the sash and the second ends 29*b* and 30*b*. One example of this would be a double scissors arm system. The mechanism described so far, except for the size of the gears 27, 28, 31 and 32, is quite typical of the prior art operators and construction could be by any suitable means, well known in the art.

The housing 17 is elongate so as to allow room for the mounting of a spring 40 which provides a counterbalancing force. Alternately, the spring could be positioned outside of the housing. The spring 40 may either be a compression spring, as shown in the drawing, or extension spring. A plate 41 is operatively connected, by suitable means such as welding, to the base 18. The spring 40 has a first end 40*a* which is operatively connected to a plate 42 and a second end 40*b* is operatively connected to a plate 43. Adjustment bolt 44 is positioned through an aperture in the plate 41. The bolt 44 may be rotated so that its threads engage the threaded aperture in the plate 41. The causes the bolt to travel in the direction of the arrows shown in FIG. 3 and thereby adjusts the compression, or preload on the spring 40.

A connecting arm 45 is pivotally mounted between the plate 43 and the second arm 30. The connecting arm 45 has a first end 45*a* and a second end 45*b*. A second connecting arm 46, at one end, is rotatably, mounted to the connecting arm 45 by a pin 47 and out the other end is secured to the plate 43 by suitable means such as welding. The first end 45*a* of the connecting arm 46 is spaced slightly away from the plate 43 such that when the arm 45 rotates slightly around the pin 47, the connecting arm 45 does not hit the plate 43. An arcuate slot 50 is formed in the first end 30*a* of the second arm member 30. The second end 45*b* of the connecting arm 45 is secured in the slot 50 by means of bolt 48 and nut 49. The nut 49 may simply be loosened and the arm 45 may be moved to any position along the slot 50 and then secured in position by means of the nut 49. This adjustment allows the user to select various spring arm lengths and different angle betas as will be described more fully hereafter. The different locations were utilized in comprising the data shown in Table I. It is also understood that the end 45*b* may be connected to the arm 30 by means such as a suitable linkage.

Figures 3, 3A, 4:
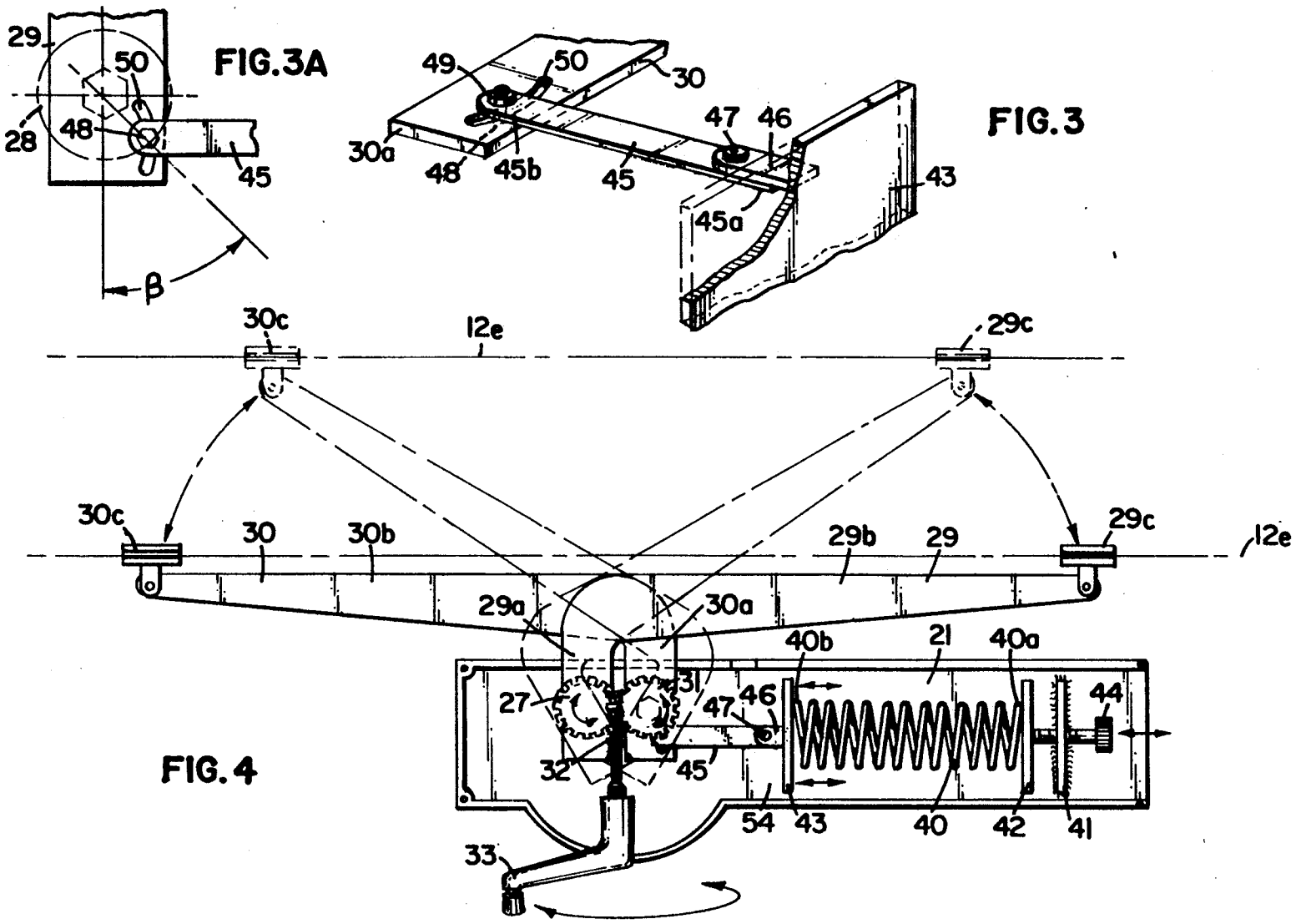
FIG. 3 is a top plan view of a portion of the window operator shown in FIG. 2.
FIG. 3*a* is a top plan view of a portion of the window operator shown in FIG. 1.
FIG. 4 is a top plan view of the operator shown in FIG. 2 with the cover removed.

FIG. 3*a* depicts the angle beta. This angle beta is necessary in calculating the torque which is provided by the spring 40. The spring arm length is the distance between the center of the bolt 48 and the center of the gear 28. However, the torque about the axis of rotation of the gear 28 is equal to the spring arm length times spring force times cosine beta. The spring force is determined by the spring preload and then by the amount of movement in plate 43 as the arms 29 and 30 rotate.

In use, the operator mechanism 16 is mounted on the sill 11*d* of the frame 11 by any means well known in the art. The crank handle 33 is operated from the inside of the building in which the window is mounted. There is typically an insect screen between the handle and the sash. The arms 29 and 30 pass under the screen.

Figure 5:
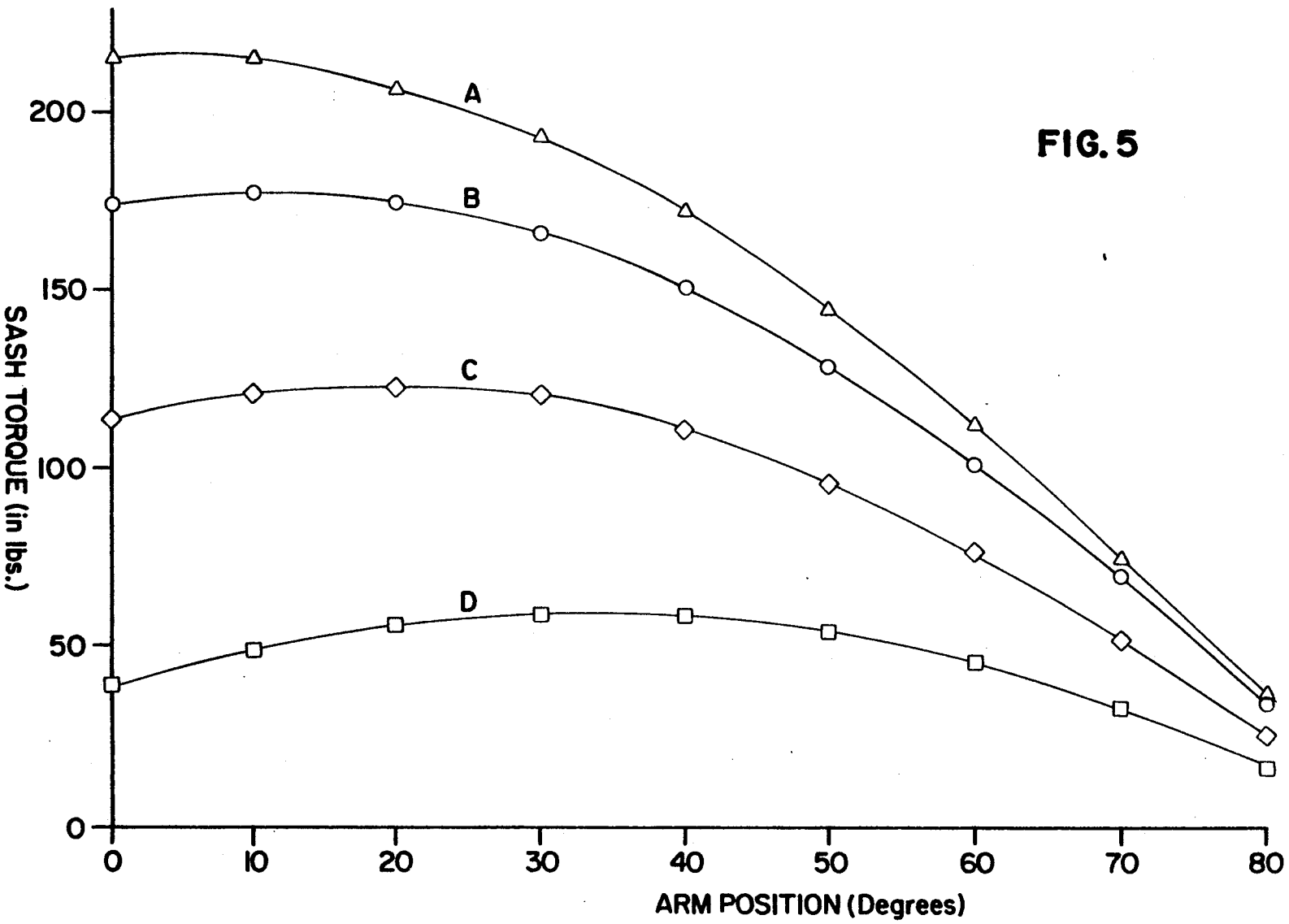
FIG. 5 is a graph of the total sash torque at the arm pivot point for arm pivot range from 0 to 80 degrees.

The torque created by a roof window will vary depending upon the size and weight of the window as well as the pitch of the roof on which the window is mounted. FIG. 5 is an example of the torque in inch pounds which is created by a 29 inch by 44 inch window that weighs 38 pounds. Line A represents a roof with an 18½° pitch, line B a 40° pitch, Line C a 60° pitch and Line D an 80° pitch. Roof pitch is measured from the horizontal. The torque is plotted against the position of the arms 29 and 30, 0° being in the closed position.

Figure 6:
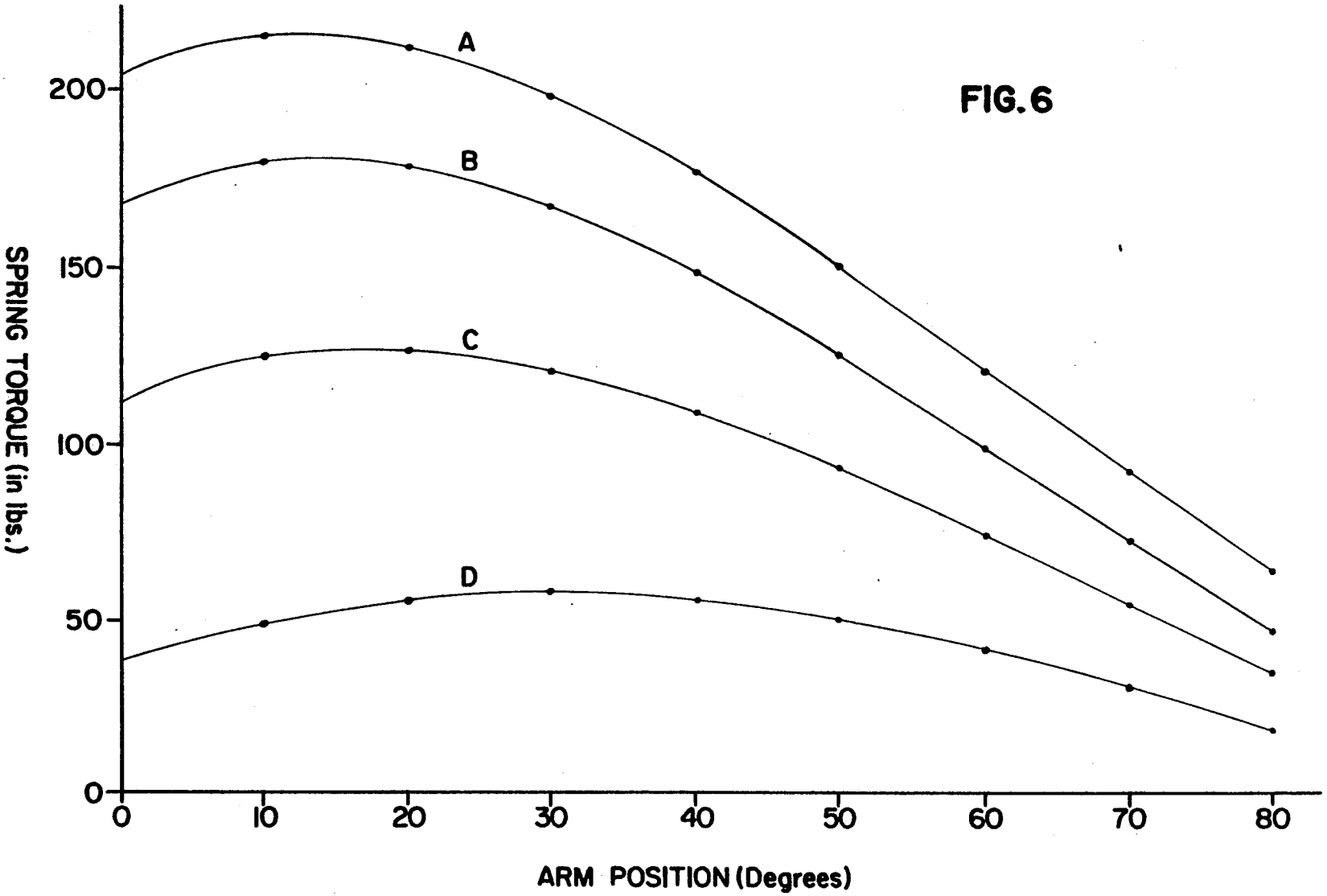
FIG. 6 is a graph showing the spring torque of the counterbalancing mechanism at arm positions of from 0 to 80 degrees.

Ideally, the spring torque would coincide exactly with the sash torque. FIG. 6 is an example of spring torque calculated under the following conditions.

TABLE I

| Line | Roof Pitch (Degrees) | Spring Arm Length (in.) | Spring Rate (lb./in) | Spring Preload (lb.) | Beta (Degrees) |
|---|---|---|---|---|---|
| A | 18½ | 5 | 30 | 80 | 42 |
| B | 40 | 4.5 | 30 | 60 | 44 |
| C | 60 | 3.5 | 30 | 40 | 50 |
| D | 80 | 2 | 30 | 20 | 65 |

The torque, using the above data, was plotted and is shown in FIG. 6. This coincides with the data calculated from the foregoing table.

By loosening the nut 49 and moving the end 45*b* over the slot 50, the spring arm length is able to be adjusted. As the spring arm length is decreased and the angle beta is increased, the amount of torque is reduced.

The connecting mechanism between the spring 40 and the arm 29 is shown as being able to be adjusted so as to adjust the spring arm length and the angle beta. This is done so that the sash torque may be more fully matched by the spring torque. While this is an ideal construction, it has been found practically that there may be a more direct connection between the spring 40 and the arm 29 and not allow for adjustments in the spring arm length and the angle beta. The sash torque can be matched by simply adjusting the spring preload. The spring preload is adjusted by the movement of the adjustment bolt 44 which either compresses or decompresses the spring 40. While the spring torque curve does not as ideally match the sash torque curve when the spring arm length and the angle beta is not adjustable, for production purposes it is found to be sufficiently close.

When the window or pivoting unit is in a closed position, the arms are in a position as shown in FIG. 4. Then, the crank is rotated which turns worm 32 and therefore worm gear 31. The worm gear 31, shaft 31*a*, which is inserted into the socket 28*a* of gear 28, and the gear 28 then drives the driven gear 27. This causes rotation of both the standoffs 25 and 26 which in turn causes the arms 29 and 30 to move in a direction as shown in dashed lines in FIG. 4. The counterbalancing torque is provided by the spring 46 and is directly transmitted to the arm 29 through the arm 45. This counterbalancing force counteracts the torque of the sash so that the crank 34 is more easily operated. Because of the counterbalancing force, a gear ratio is able to be used which will allow the fourteen or less revolutions of the crank to result in the arms rotating from a closed (0°) to an open (80°) position. It is the reduction between the gear 31 and worm 32 which determine how many revolutions are necessary to open and close the window completely. Because of the counterbalancing force, the reduction can be further reduced from the 63:1 ratio to a 27:1 ratio which would allow only six revolutions to move between an open and closed position. As the window is opened, the torque will vary similar to that shown in FIGS. 5 and 6. As the arm 29 moves, arm 45 will also move, thereby moving the plate 43 and the spring compression. The pin 47 allows the arm 45 to rotate to compensate for the arm 29*a* moving in an arcuate movement.

In addition to the advantages previously shown and discussed with the present invention, the present invention also has the advantage of allowing a window to be designed which is not restricted by large hollow sash profiles. In prior art devices, the large hollow sash profiles were necessary to house the spring mechanism and hardware within the sash or frame. With the present invention, it is no longer necessary and one is able to have a much "cleaner" or thinner sash profile.

Figure 7:
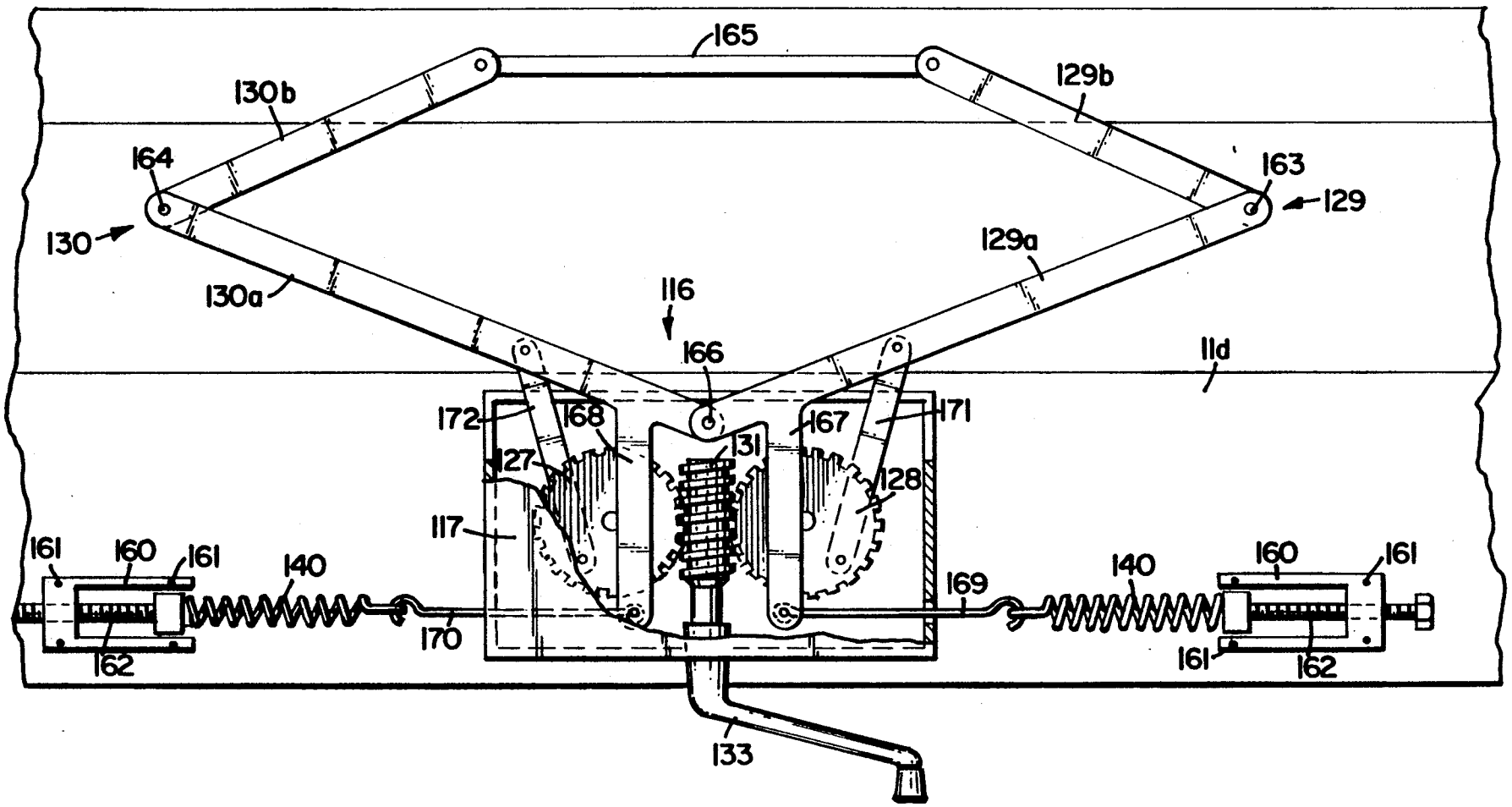
FIG. 7 is a top plan view of another embodiment of the counterbalanced window operator of this invention.

After the initial conception reduction to practice of this invention, the assignee of the present application, Andersen Corporation, began a joint development effort with Roto Frank AG. During this joint development, the inventors of the present application worked in close conjunction with employees of Roto Frank AG and developed what is presently thought to be the embodiment which will be the production when a counterbalanced operator to be sold by Andersen Corporation. This embodiment of the present invention is shown in FIG. 7. There are five major differences between the previously described embodiment and the embodiment shown in FIG. 7. The first is the use of a double scissors arm mechanism. The second is the use of two extension springs instead of one compression spring which are operatively connected to the sill 11*d*. The third is the use of an over center concept. The fourth is that the worm directly drives both gears. The fifth is that there is only an adjustment of the spring preload and not of the arm length and angle $\beta$.

The counterbalanced window operator 116 is mounted to the sill 11*d*. The mechanism includes a housing 117 which is mounted, by suitable means such as screws, to the sill 11*d*. The housing 117 has an opening through which the crank handle 133 may protrude. Two gears 127 and 128 are mounted by standoffs (not shown) to a base plate of the housing 117. A worm 131 is operatively positioned between the two gears 127 and 128. Two adjustment brackets 160 are secured to the sill 11*d* by suitable means such as screws 161. Threaded bolts 162 are operatively mounted in threaded holes in the adjustment brackets 160. Rotation of the bolts 162 causes the bolts to move with respect to the brackets 160. At the end of the bolts 162 are attached extension springs 140.

The double scissors arm system includes a first arm 129 and a second arm 130. The first arm 129 has a first section 129*a* and a second section 129*b*. Similarly, the second arm has a first section 130*a* and a second section 130*b*. The first and second sections are pivotally connected by means of a pin 163 and 164, respectively. The second sections 129*b* and 130*b* are secured to the bottom member 12*d*, which is the rotatable end of the window, by any suitable means. The second sections are joined by a crossbar 165. The first sections 129*a* and 130*a* are pivotally mounted together by pin 166. Downwardly depending (as viewed in FIG. 7) arm members 167 and 168 are rigidly connected at one end to the sections 129*a* and 130*a*. At the other end, the arm members 167 and 168 are designed to be connected to the spring 140. As shown in the drawing, an aperture is formed in each of the arm members 167 and 168. A first connecting member 169 connects the arm member 167 to the spring 140 and the second connecting member 170 operatively connects the other arm member 168 to the other spring 140. In one embodiment, it is contemplated that in production the adjustment brackets would be fixed at a certain distance away from the housing 170 independent of the weight of the window and the pitch of the roof. Then, depending upon the weight of the window and the pitch of the roof, different sized springs 140 may be utilized. Adjustments may be made to the preload of the springs 140 by movement of the adjustment bolts 162 in the adjustment brackets 161.

One additional feature of this embodiment is the use of the over center members 171 and 172. One end of the members 171 and 172 is respectively connected to the sections 129*a* and 130*a*. The other ends are operatively connected to the gears 128 and 127 respectively. The members 171 and 172 are positioned such that when the window is substantially closed, the points of attached and the center of their respective gears form a straight line. Then, one additional turn of the crank 133 provides a substantial closing force to make certain that the window is very tightly closed. A stop can be position such that the crank can not make more than one additional turn past this point.

Other modifications of the invention will be apparent to those skilled in the art in light of the foregoing description. This description is intended to provide specific examples of individual embodiments which clearly disclose the present invention. Accordingly, the invention is not limited to these embodiments or the use of elements having specific configurations and shapes as presented herein. All alternative modifications and variations of the present invention which follow in the spirit and broad scope of the appended claims are included.

We claim:

1. A counter-balanced operator for a pivoting unit, the unit having a first, pivoted end and a second, rotatable end, said operator comprising:

(a) a housing;

(b) a rotatable drive member operatively mounted in said housing, said drive member having an axis of rotation;

(c) an arm member having first and second ends, said first end operatively connected to said drive member;

(d) said second end of said arm member operatively connected to the second end of the pivoting unit, wherein a torque from the unit is transmitted to said arm member;

(e) rotating drive means for rotating said drive member; and (f) means for counterbalancing the torque on said arm member, said counterbalancing means creating a force, said counterbalancing means operatively connected to said arm member, and said counterbalancing means occupying a fixed orientation relative to said housing, the force being transmitted to said arm member.

2. The operator of claim 1, wherein said drive means comprises:

(a) a crank handle;

(b) a worm drive, said worm drive being rotated by rotation of said crank handle; and (c) a worm gear in operative engagement with said worm drive, said worm gear having a propelling member operatively connected thereto.

3. The operator of claim 1, wherein said counterbalancing means comprises a spring operatively connected to said arm member.

4. The operator of claim 3, further comprising a lever arm operatively connected to said arm member and said spring operatively connected to said lever arm at an attachment point.

5. The operator of claim 3, further comprising means for adjusting a preload force on said spring.

6. The operator of claim 1, wherein said arm member comprises a first arm and a second arm, said first arm operatively connected to said drive member and said second arm operatively connected to a driven member, said driven member in operative engagement with said drive member.

7. The operator of claim 6, wherein said first and second arms cross over each other.

8. The operator of claim 1, wherein 14 or less revolutions of said rotating drive means results in a movement between a closed to an open position.

9. A counter-balanced operator for a pivoting unit, the unit having a first, pivoted end and a second, rotatable end, said operator comprising:

(a) a housing;

(b) a rotatable drive member operatively mounted in said housing, said drive member having an axis of rotation;

(c) an arm member having first and second ends, said first end operatively connected to said drive member;

(d) said second end of said arm member operatively connected to the second end of the pivoting unit, wherein a torque from the unit is transmitted to said arm member;

(e) rotating drive means for rotating said drive member wherein said drive means comprises:

(i) a crank handle;

(ii) a worm drive, said worm drive being rotated by rotation of said crank handle; and (iii) a worm gear in operative engagement with said worm drive, said worm gear having a propelling member operatively connected thereto; and said drive member has a socket configured to receive said propelling member; and (f) means for counterbalancing the torque on said arm member, said counterbalancing means creating a force, said counterbalancing means operatively connected to said arm member, the force being transmitted to said arm member.

10. A counter-balanced operator for a pivoting unit, the unit having a first, pivoted end and a second, rotatable end, said operator comprising:

(a) a housing;

(b) a rotatable drive member operatively mounted in said housing, said drive member having an axis of rotation;

(c) an arm member having first and second ends, said first end operatively connected to said drive member;

(d) said second end of said arm member operatively connected to the second end of the pivoting unit, wherein a torque from the unit is transmitted to said arm member;

(e) rotating drive means for rotating said drive member;

(f) means for counterbalancing the torque on said arm member, said counterbalancing means creating a force, said counterbalancing means comprising a spring operatively connected to said arm member, the force being transmitted to said arm member;

(g) a lever arm operatively connected to said arm member and said spring operatively connected to said lever arm at an attachment point; and
(h) means for adjusting position of said attachment point with respect to the axis of rotation.

11. A counter-balanced operator for a pivoting window, the window having a first pivoting end and a second rotatable end, said operator comprising:
(a) a housing;
(b) a rotatable drive member operatively mounted in said housing, said drive member having an axis of rotation;
(c) an arm member having first and second ends, said first end operatively connected to said drive member;
(d) said second end of said arm member operatively connected to the second end of the window, wherein when a torque from the unit is transmitted to said arm member;
(e) rotating drive means for rotating said drive member wherein said drive means comprises:
(i) a crank handle;
(ii) a worm drive, said worm drive being rotated by rotation of said crank handle; and
(iii) a worm gear in operative engagement with said worm drive, said worm gear having a propelling member operatively connected thereto, and said drive member has a socket configured to receive said propelling member; and
(f) means for counterbalancing the torque on said arm member, said counterbalancing means creating a force, said counterbalancing means operatively connected to said arm member, the force being transmitted to said arm member.

12. A counter-balanced operator for a pivoting window, the window having a first pivoting end and a second rotatable end, said operator comprising:
(a) a housing;
(b) a rotatable drive member operatively mounted in said housing, said drive member having an axis of rotation;
(c) an arm member having first and second ends, said first end operatively connected to said drive member;
(d) said second ends of said arm member operatively connected to the second end of the window, wherein when a torque from the unit is transmitted to said arm member;
(e) rotating drive means for rotating said drive member; and
(f) means for counterbalancing the torque on said arm member, said counterbalancing means creating a force, said counterbalancing means comprises a spring operatively connected to said arm member, the force being transmitted to said arm member
(g) a lever arm operatively connected to said arm member and said spring operatively connected to said lever arm at an attachment point; and
(h) means for adjusting position of said attachment point with respect to the axis of rotation.

13. A window comprising:
(a) a frame having a top end and a bottom end;
(b) a sash having a top end and a bottom end, said sash configured to engage said frame and said top end of said sash pivotally mounted to said top end of said frame, said bottom end being a rotatable end;
(c) a counterbalanced operator, said operator comprising:
(i) a housing;
(ii) a rotatable drive member operatively mounted in said housing, said drive member having an axis of rotation;
(iii) an arm member having first and second ends, said first end operatively connected to said drive member;
(iv) said second end of said arm member operatively connected to the second end of said sash, wherein a torque from the sash is transmitted to said arm member;
(v) rotating drive means for rotating said drive member; and
(vi) means for counterbalancing the torque on said arm member, said counterbalancing means creating a force, said counterbalancing means comprises a spring operatively connected to said arm member, the force being transmitted to said arm member; and
(vii) means for adjusting position of said attachment point with respect to the axis of rotation.

14. A counter-balanced operator for a pivoting window, the window having a first pivoting end and a second rotatable end, said operator comprising:
(a) a housing;
(b) a rotatable drive member operatively mounted in said housing, said drive member having an axis of rotation;
(c) an arm member having first and second ends, said first end operatively connected to said drive member;
(d) said second end of said arm member operatively connected to the second end of the window, wherein when a torque from the unit is transmitted to said arm member;
(e) rotating drive means for rotating said drive member;
(f) means for counterbalancing the torque on said arm member, said counterbalancing means creating a force, said counterbalancing means operatively connected to said arm member, the force being transmitted to said arm member; and
(g) means, operatively connected to said counterbalancing means, for adjusting the force created and transmitted by said counterbalancing means.

15. The operator of claim 14, wherein said drive means comprises:
(a) a crank handle;
(b) a worm drive, said worm drive being rotated by rotation of said crank handle; and
(c) a worm gear in operative engagement with said worm drive, said worm gear having a propelling member operatively connected thereto.

16. The operator of claim 14, wherein said counterbalancing means comprises a spring operatively connected to said arm member.

17. The operator of claim 16, further comprising a lever arm operatively connected to said arm member and said spring operatively connected to said lever arm at an attachment point.

18. The operator of claim 16, further comprising means for adjusting a preload force on said spring.

19. The operator of claim 14, wherein said arm member comprises a first arm and a second arm, said first arm operatively connected to said drive member and said second arm operatively connected to a driven member, said driven member in operative engagement with said drive member.

20. The operator of claim 19, wherein said first and second arms cross over each other.

21. The operator of claim 14, wherein 14 or less revolutions of said rotating drive means results in a movement between a closed to an open position.

22. A window comprising:

(a) a frame having a top end and a bottom end;

(b) a sash having a top end and a bottom end, said sash configured to engage said frame and said top end of said sash pivotally mounted to said top end of said frame, said bottom end being a rotatable end;

(c) a counterbalanced operator, said operator comprising:

(i) a housing;

(ii) a rotatable drive member operatively mounted in said housing, said drive member having an axis of rotation;

(iii) an arm member having first and second ends, said first end operatively connected to said drive member;

(iv) said second end of said arm member operatively connected to the second end of said sash, wherein a torque from the sash is transmitted to said arm member;

(v) rotating drive means for rotating said drive member; and (vi) means for counterbalancing the torque on said arm member, said counterbalancing means creating a force, said counterbalancing means operatively connected to said arm member, and said counterbalancing means occupying a fixed orientation relative to said housing, the force being transmitted to said arm member.

23. The window of claim 22, wherein said drive means comprises:

(a) a crank handle;

(b) a worm drive, said worm drive being rotated by rotation of said crank handle; and (c) a worm gear in operative engagement with said worm drive, said worm gear having a propelling member operatively connected thereto.

24. The window of claim 23, wherein said arm member comprises a first arm and a second arm, said first arm operatively connected to said drive member and said second arm operatively connected to a driven member, said driven member in operative engagement with said drive member.

25. The window of claim 24, wherein said first and second arms cross over each other.

26. The window of claim 22, wherein said counterbalancing means comprises a spring operatively connected to said arm member.

27. The window of claim 22, wherein 6 or less revolutions of said rotating drive means results in a movement of 12 or more inches of the rotatable end.

28. A window comprising:

(a) a frame having a top end and a bottom end;

(b) a sash having a top end and a bottom end, said sash configured to engage said frame and said top end of said sash pivotally mounted to said top end of said frame, said bottom end being a rotatable end;

(c) a counterbalanced operator, said operator comprising:

(i) a housing;

(ii) a rotatable drive member operatively mounted in said housing, said drive member having an axis of rotation;

(iii) an arm member having first and second ends, said first end operatively connected to said drive member;

(iv) said second end of said arm member operatively connected to the second end of said sash, wherein a torque from the sash is transmitted to said arm member;

(v) rotating drive means for rotating said drive member wherein said drive means comprises:

(1) a crank handle;

(2) a worm drive, said worm drive being rotated by rotation of said crank handle; and (3) a worm gear in operative engagement with said worm drive, said worm gear having a propelling member operatively connected thereto, and said drive member has a socket configured to receive said propelling member; and (vi) means for counterbalancing the torque on said arm member, said counterbalancing means creating a force, said counterbalancing means operatively connected to said arm member, the force being transmitted to said arm member.

29. The window of claim 28, further comprising a lever arm operatively connected to said arm member and said spring operatively connected to said lever arm at an attachment point.

30. The window of claim 28, further comprising means for adjusting a preload force on said spring.

* * * * *